US005746909A

United States Patent [19]

Calta

[11] Patent Number: 5,746,909

[45] Date of Patent: May 5, 1998

[54] PROCESS FOR EXTRACTING TAR FROM TARSAND

[76] Inventor: Jeffrey S. Calta, P.O. Box T, Chicora, Pa. 16025

[21] Appl. No.: 744,764

[22] Filed: Nov. 6, 1996

[51] Int. Cl.[6] ..... C10G 1/04

[52] U.S. Cl. ..... 208/390; 208/391

[58] Field of Search ..... 208/390, 309, 208/391

[56] References Cited

U.S. PATENT DOCUMENTS

| | | | |
|---|---|---|---|
| 4,089,698 | 5/1978 | Corbett | 106/278 |
| 4,781,819 | 11/1988 | Chirinos et al. | 208/324 |
| 4,968,412 | 11/1990 | Guymon | 208/309 |
| 5,171,475 | 12/1992 | Freisleben | 252/312 |
| 5,282,984 | 2/1994 | Ashrawi | 106/272 |
| 5,316,364 | 5/1994 | Grogoli et al. | 208/304 |
| 5,340,467 | 8/1994 | Gregoli et al. | 208/309 |

OTHER PUBLICATIONS

Sury, K.N., et al. "Next Generation Oilsands Technology: The New Oslo Process", *Imperial Oil Resources Limited*; pp. 1–34.

*Primary Examiner*—Helane Myers

*Attorney, Agent, or Firm*—Sughrue, Mion, Zinn, Macpeak & Seas, PLLC

[57] ABSTRACT

Tar is separated and recovered from tarsands using an extraction process useful even in cold water which utilizes a liquid admixture of a high boiling alkane; e.g. naphtha, an anionic surfactant and water.

15 Claims, No Drawings

PROCESS FOR EXTRACTING TAR FROM TARSAND

FIELD OF THE INVENTION

The present invention relates to an extraction process for the recovery of tar from tarsands. More particularly, the present invention is directed to a water extraction process useful even with cold water which effectively separates and recovers tar from tarsands such as occur, for example, in the Athabasca tarsands in Alberta, Canada, using a liquid admixture comprising at least one high boiling alkane; e.g., naphtha, an anionic surfactant and water.

BACKGROUND OF THE INVENTION

Flotation processes for the beneficiation of bitumen, i.e., tar, from tarsands at temperatures of about 85° C., known as hot water processes and typified by the Clark hot water process, are well known. However, such processes require the input of considerable thermal energy, much of which is not recoverable and is lost in the discharge of tailings which constitute in excess of 80% of the materials handled in the form of water and spent sands. Conventional hot water process plants must also normally be located in proximity to a supply of heat, thus necessitating costly transportation of the tarsands to central processing units close to thermal plants such as oil refineries.

The separation of bitumen from tarsands at substantially ambient temperatures would obviate the need for the separation plant to be close to a supply of heat and would permit separation of bitumen from the sands in proximity to the mining operation, thus minimizing the cost of transporting the solids which comprise by far the bulk of the materials handled, while facilitating the return of separated sand and fine solids to disposal areas.

Conventional dry mining of tarsands is accomplished by means of power shovels, draglines, bucketwheels, as well as other large earth moving equipment. Wet mining can be accomplished in open pits by means of rotary excavators in combination with slurry pumps operating from a dredge or by water jets in combination with mechanical equipment, and for deep deposits, by means of high pressure water jets in combination with slurry pumps in boreholes.

A flotation process which operates at ambient temperatures would provide the important advantage of permitting the choice of conventional dry mining techniques or wet mining techniques, the dry mining techniques employing hydraulic pipeline transportation of the mined tarsands to a separation plant and the wet mining techniques employing dredge mining, water jetting or borehole mining with the option of hydraulic pipeline transportation of the tarsands to a separation plant or the processing of the tarsands on a dredge or adjacent a plurality of boreholes in an integrated mining and beneficiation operation with return of tailings directly to a tailings pond.

Dredge mining, water jet mining in open pits or borehole mining of tarsands integrated with an ambient or low temperature flotation process would provide the important advantage of utilizing the shear energy consumed during the mining operation in water for initial disintegration of the tarsands and fragmentation of the bitumen for release from the sands preliminary to flotation.

Canadian Pat. No. 741,301 discloses the use of mechanical agitation and high energy water jets to form a slurry for flotation of bitumen in a hot water process. Canadian Pat. No. 915,608 discloses the use of shearing energy applied to an aqueous bituminous emulsion to coalesce and remove water therefrom at medium temperatures.

A low temperature process for the separation and recovery of bitumen i.e., tar, has been developed and is disclosed in U.S. Pat. No. 4,946,597 to Sury. More specifically, the process disclosed in the aforementioned U.S. patent comprises the steps of slurrying tarsands in water at a temperature of above about freezing to 35° C., mixing the slurry with a conditioning agent, such as kerosene, diesel oil or a mixture thereof, for a time sufficient to release bitumen from tarsands and to uniformly dispense the conditioning agent on the bitumen, and subjecting the resulting slurry to froth flotation using methyl-isobutyl-carbinol (MIBC) as the frother for the recovery of bitumen.

Despite the current state in the art there is still a continued need to provide an extraction process which eliminates the high energy costs that are associated with hot water extraction processes and to provide an alternative process to the cold water extraction process disclosed hereinabove.

SUMMARY OF THE INVENTION

The present invention, which overcomes the aforementioned drawbacks, is directed to an extraction process useful with hot or cold water for the recovery of tar from tarsands. More specifically, the present invention is directed to an extraction process which comprises the steps of: (a) forming a slurry comprising tarsand, an anionic surfactant, at least one high boiling alkane, wherein said alkane boils within the range of from 225°–500° F. at 760 mm Hg and water; (b) mixing the slurry provided in step (a) under conditions effective to remove tar from the tarsand and to form a mixture of (i) substantially tar-free sand and (ii) an emulsion comprising said removed tar, the anionic surfactant, high boiling alkane and water; (c) separating said substantially tar-free sand from the emulsion; and (d) separately treating the emulsion to separate tar therefrom.

It should be noted that the method of the instant invention for the separation and recovery of tar from tarsands eliminates the high energy costs as well as the other processing problems mentioned hereinabove for hot water extraction processes. It also provides an alternative process to the cold water process described in U.S. Pat. No. 4,946,597 which requires the use of a conditioning agent, such as kerosene and a frother, such as MIBC.

DETAILED DESCRIPTION OF THE INVENTION

As indicated hereinabove, the present invention relates to an extraction process useful even with cold water, for the separation and recovery of tar from tarsands. Tarsands are sands, typically silicates which are predominantly silica containing other inorganic silicates and other oxides, intimately commingled with "tar", that is, high molecular weight hydrocarbons which are typically solid or near-solid and highly viscous at ambient temperatures (20°–25° C.). As is known, tarsands occur naturally and are mined by dry mining, hydraulic dredge mining or by water jet or borehole mining.

More specifically, the tar extraction process of the present invention comprises the steps of:

(a) forming a slurry comprising tarsand, an anionic surfactant, at least one high boiling alkane, said alkane boils within the range of from 225° F.–500° F. at 760 mm Hg and water;

(b) mixing said slurry under conditions effective to remove tar from the tarsand and to form a mixture of (i)

substantially tar-free sand, being the tarsand from which tar has been removed, and (ii) an emulsion comprising said removed tar, said anionic surfactant, at least one high boiling alkane and water;

(c) separating said substantially tar-free sand from said emulsion; and (d) separately treating said emulsion to separate said tar therefrom. Optionally, though preferably, the sand is also treated separately to remove therefrom any residual tar.

In accordance with the first step of the present invention, a slurry comprising tarsand, at least one high boiling alkane, an anionic surfactant and water is provided. The slurry can be provided by admixing the aforementioned components together in any order. For example, the tarsand can be slurried by adding it to a liquid admixture containing at least one high boiling alkane, an anionic surfactant and water. The preferred sequence comprises first forming a high boiling alkane/anionic surfactant solution and thereafter adding tarsand and then water to the solution.

It should also be noted that the liquid components used in the present invention, i.e., high boiling alkane, anionic surfactant and water, as well as their relative amounts are so selected such that they are capable of being emulsified under the reaction conditions employed in the instant invention and that they are able to solubilize or suspend tar off of the tarsand.

The high boiling alkanes utilized in the present invention are aliphatic, i.e., saturated, linear or branched hydrocarbons or mixtures which boils within the range of from about 225° F. to about 500° F., more preferable from about 250° F. to about 300° F., at 760 mm Hg. Suitable examples of such high boiling alkanes include, but are not limited to, n-heptane, n-octane, n-nonane, n-decane, n-undecane, n-dodecane, naphtha, i-octane, i-nonane, i-decane and the like. As stated above, mixtures of these high boiling alkanes are also contemplated herein. A highly preferred high boiling alkane employed in this invention is naphtha which is an aliphatic mixture of branched hydrocarbons that boils within the range of 250° F.–300° F. at 760 mm Hg.

Suitable anionic surfactants employed in the present invention which satisfy the above conditions include water-soluble salts of $C_8$–$C_{22}$ alkyl benzene sulfonates, $C_8$–$C_{22}$ alkyl sulfates or sulfonates, $C_{10}$–$C_{18}$ alkylether sulfates or sulfonates, $C_8$–$C_{22}$ alkyl or alkenyl polyglyceryl sulfonates, $C_9$–$C_{22}$ alkylether sulfonates, $C_8$–$C_{22}$ alkylpolyethoxy ether sulfates containing 1 to 12 ethoxy units, $C_6$–$C_{22}$ alpha-olefin sulfonates, $C_8$–$C_{22}$ fatty acid monoglyceride sulfates and sulfonates, $C_8$–$C_{22}$ alkylphenol polyethoxy ether sulfates containing 1 to 12 ethoxy units, 2-acyloxy-alkane-1-sulfonate, and beta-alkyloxy alkane sulfonate. Monosubstituted petroleum sulfonates can also be used in the present invention as the anionic surfactant. Mixtures of these surfactants are also contemplated by the present invention. Of the foregoing anionic surfactants, the alpha-olefin sulfonates containing 6 to 20 carbon atoms or the monosubstituted petroleum sulfonates are highly preferred in the present invention.

A particularly suitable class of anionic surfactants employed in the present invention includes water-soluble salts, particularly the alkali metal, ammonium and alkanolammonium salts of organic sulfuric reaction products having in their molecular structure an alkyl or alkaryl group containing from about 8 to about 22, especially from about 10 to about 20, carbon atoms and a sulfonic acid or sulfuric acid ester group. (Included in the term "alkyl" is the alkyl portion of acyl groups). Examples of this group of anionic surfactant which may be utilized by the present invention are the sodium and potassium alkyl sulfates, especially those obtained by sulfating the higher alcohols ($C_8$–$C_{18}$) carbon atoms produced by reducing the glycerides of tallow or coconut oil and sodium and potassium alkyl benzene sulfonate, in which the alkyl group contains from about 9 to about 15, especially about 11 to about 13, carbon atoms, in straight chain or branched chain configuration, e.g. those of the type described in U.S. Pat. Nos. 2,220,099 and 2,477,383 and those prepared from alkylbenzenes obtained by alkylation with straight chain chloroparaffins (using aluminum trichloride catalyst) or straight chain olefins (using hydrogen fluoride catalysts). Especially valuable are linear straight chain alkyl benzene sulfonate in which the average of the alkyl group is about 11.8 carbon atoms, abbreviated as $C_{11.8}$LAS.

Other anionic surfactants that can be employed herein in step (a) include the sodium $C_{10}$–$C_{18}$ alkyl glyceryl ether sulfonates, especially those ethers of higher alcohols derived from tallow and coconut oil; sodium coconut oil fatty acid monogylceride sulfonate and sulfates; and sodium or potassium salts of alkyl phenol ethylene oxide ether sulfate containing about 1 to about 10 units of ethylene oxide per molecule and wherein the alkyl groups contain about 8 to about 12 carbon atoms.

Other useful anionic surfactants that can be employed in the present invention include the water-soluble salts of esters or a-sulfonated fatty acids containing from about 6 to about 20 carbon atoms in the fatty acid group and from about 1 to about 10 carbon atoms in the ester group; water-soluble salts of 2-acyloxy-alkane-1-sulfonic acids containing from about 2 to about 9 carbon atoms in the acyl group and from about 9 to about 23 carbon atoms in the alkane moiety; alkyl ether sulfates containing from about 10 to about 18, especially about 12 to about 16, carbon atoms in the alkyl group and from about 1 to about 12, especially 1 to about 6, more especially about 1 to about 4 moles of ethylene oxide; water-soluble salts of olefin sulfonate containing from about 12 to about 24, preferably about 14 to about 16, carbon atoms, especially those made by reaction with sulfur trioxide followed by neutralization under conditions such that any sulfones present are hydrolysed to the corresponding hydroxy alkane sulfonate; water-soluble salts of paraffin sulfonate containing from about 8 to about 24, especially about 14 to about 18 carbon atoms, and β-alkyloxy alkane sulfonate containing from about 1 to about 3 carbon atoms in the alkane moiety.

The alkane chains of the foregoing anionic surfactants can be derived from natural sources such as coconut oil or tallow, or can be made synthetically as for example using the Ziegler or Oxo processes. Water solubility can be achieved by using alkali metal, ammonium or alkanolammonium cations; sodium is preferred. Magnesium and calcium are preferred cations under circumstances described by Belgian Pat. No. 843,636 invented by Jones et al, issued Dec. 30, 1976.

In accordance with a highly preferred embodiment of the present invention, an anionic surfactant which is dissolved in naphtha such that a naphtha/anionic surfactant solution is provided. By "naphtha" is meant an aliphatic blend of branched alkanes having boiling points in the range of 250° F. to 500° F.

Typically, in the present invention from about 0.1 to about 1 weight % of the anionic surfactant, based on the tarsand weight, is added to an amount of high boiling alkane which is about 2.5 to about 25 weight % based on the tarsand weight. More preferably, about 0.1 to about 0.75 weight % of a anionic surfactant is dissolved in about 2.5 to about 18.75 weight % high boiling alkane, all weights being based on the tarsand weight. Most preferably, about 0.2 weight % of an anionic surfactant is added to about 5 weight % high boiling alkane.

After the anionic surfactant is dissolved in the high boiling alkane, tarsand is added to the alkane/anionic surfactant solution in an amount such that the amounts of anionic surfactant and high boiling alkane conform to the foregoing ranges.

Water, in a quantity which is sufficient to form a slurry, is then added and the resulting slurry can then be subjected to either heating or cooling to a temperature which is sufficient to optimize recovery of tar from the tarsand. More specifically, the slurry containing the tarsand, water, high boiling alkane and anionic surfactant is brought to the desired temperature by heating or cooling the slurry, as necessary, to a temperature of from about 32° F. to about 80° F. More preferably, the slurry is heated to a temperature in the range of from about 34° F. to about 41° F.

Once the desired temperature is reached and has been maintained for about 1 to about 5 minutes, the slurry is then agitated under conditions effective to remove tar from the tarsand and to suspend and/or solubilize the tar, to form an emulsion comprising the removed tar, high boiling alkane, anionic surfactant and water.

During the agitation, the emulsion remains admixed with sand derived from the tarsand. After the slurry has been thoroughly mixed, it is allowed to settle for a period of time which is sufficient to separate the slurry into two distinct phases; i.e., an upper phase and a lower phase. The upper phase comprises an emulsion of tar, high boiling alkane, anionic surfactant and water whereas the resultant lower phase comprises substantially tar-free sand. By substantially tar-free sand, it is meant that the tarsand in the lower phase contains about 0 up to about 3.0% tar. More preferably the phrase "substantially tar-free" implies that the tarsand in the lower phase contains up to about 0.5% tar.

The foregoing mixing step may be carried out using any conventional mixing apparatus such as a mechanical shaker or high-shear impeller for a period of time of from about 5 minutes to about 3 hours. More preferably, the mixing step is carried out in a mechanical shaker for a period of time of from about 15 minutes to about 45 minutes. Most preferably, the foregoing mixing step is carried out for about 25 minutes to about 35 minutes.

The resultant phases which are formed after settling are then separated such that the upper phase is removed from the lower phase. The separation may be conducted using techniques that are well known in the art such as decantation or filtration (vacuum or gravity). In a preferred embodiment of the present invention, the two phases are separated from each other by decanting the upper phase into a separate reaction vessel.

Tar from each of the isolated phases is then separately recovered using the following treatments. Specifically, tar from the lower phase is recovered by first adding water to the substantially tar-free sand and then subjecting this admixture to air-sparging which serves to float the residual tar out of the sand.

Typically, in the present invention from about 100 to about 600% water by weight of tar in the lower phase is added in this step of the extraction process. More preferably, from about 100 to about 200% water by weight of tar in the lower phase is added prior to air-sparging.

In the upper phase which comprises the emulsion of tar, high boiling alkane, anionic surfactant and water, the tar is removed by adding an alkaline compound, preferably sodium hydroxide, to the upper phase and then mixing the resultant admixture under conditions sufficient to precipitate tar from the emulsion. In an alternative method of the present invention, tar is removed from the upper phase using air flotation and then skimming the tar from the surface of the upper phase.

When sodium hydroxide is employed, about 2 to about 12% NaOH is added by weight of tar in the emulsion. More preferably, from 2 to about 2.5% NaOH is added by weight of tar in the upper phase. This admixture, i.e., NaOH and the upper phase is mixed using a mixing apparatus such as described above for a period of time of from about 10 to about 15 minutes. More preferably, mixing of the NaOH/upper phase admixture is carried out for a time period of about 5 to about 10 minutes.

By employing the foregoing extraction process of the present invention which works well with hot or cold water, a yield of at least about 90 to about 95% of the tar initially present in the tarsand can be recovered from tarsand.

The invention will be described further with reference to the following example, which is intended for purposes of illustration and should not be construed as limiting the scope of the invention.

The above embodiments are given to illustrate the scope and spirit of the present invention. These embodiments will make apparent, to those skilled in the art, other embodiments which are also within the contemplation of the present invention. Therefore, the present invention should be limited only by the appended claims.

EXAMPLE 1

PRELIMINARY STEPS

Tar sand was placed on a paper towel and large rock pieces were removed. The remaining tar sand was crushed with a spatula until judged to contain pieces no larger than ¼ inch.

A NaOH solution was used to add a precise amount of NaOH in the demulsion step. A 50 wt % solution of NaOH (plant sample) was diluted with water and titrated with standardized sulfuric acid.

DIGESTION STEP

The sulfonate was added to a 1 pint jar along with the required naphtha. The jar was warmed slightly on a steam box to dissolve the sulfonate. The jar was re-weighed and any lost naphtha was replaced. The tar sand was added along with water. The jar was then capped tightly and placed in a freezer for about 35 to about 40 minutes which was found to reduce the temperature to approximately 35° F. The temperature of the mixture after removing the jar from the freezer was then recorded.

The print jar was then wrapped with insulative material, secured in a shaker device and agitated for the required time.

DETERMINATION OF UNDIGESTED TAR SAND

Upon removal of the sample from the shaker device, the color of mixture was checked. A properly emulsified sample has a rich chocolate brown color resembling a coffee/milk solution. A "poor" emulsion has a dark gray color with bits of tar floating on the surface.

The entire contents of sample jar was then pour through a tared piece of metal window screen into a tall form 1000 ml beaker. A fine jet of water was used to rinse the sample jar clean. This rinsing continued until all free sand and solution was transferred into the 1000 ml beaker. The screen was allowed to drip dry for a few minutes and was next blotted dry with paper towel. The screen was then washed.

The digested sand/water washings was allowed to settle in the 1000 ml beaker for Y2 hour to allow the tar-free sand to settle on the bottom. This enables the water/tar/naphtha/surfactant solution to be easily decanted from the sand fines. The water solution was then decanted into a tared 600 ml tall form beaker. The weight of the water solution was recorded.

DEMULSIFICATION STEP 2 wt% NaOH was used to precipitate the tar from the water solution. An alkylaryl polyether alcohol coagulant was then added to the water solution. Next, NaOH was added to the water solution until a brown/black precipitate settled out and left a clear solution above. The mls of the NaOH solution required to produce a precipitate was recorded. The precipitate was then allowed to settle for 5–10 minutes and the water above it was removed by decantation. The precipitate was then allowed to sit for about ½ hour and any water that separated out was thereafter decanted. The weight of this precipitate as "wet tar" was then recorded. The wet tar was then placed in oven at 210° F. for about 4 hours, cooled, reweighed, and this weight was recorded as "dry tar".

RECOVERED SAND PURIFICATION

Next, 400 mls water was added to the tall form 1000 ml beaker containing the digested sand. An air sparge tube was added to the beaker and air was bubbled through the solution using a magnetic stirring. Tar from the froth was skimmed and collected in a tared 250 ml beaker and the dried in an oven at 210° F. for about 4 hours. The weight of the dried sample was then recorded. Since sand fines also accompany this recovered tar, the dried tar in naphtha was dried filtered through a tared piece of filter paper and this weight was recorded and used to determine the sand % and tar %.

LAB RUN OF COLD WATER PROCESS

| | |
|---|---|
| Grams sulfonate | 0.20 |
| Grams naphtha | 2.80 |
| Grams tar sand | 50.0 |
| Grams water | 100.0 |
| Agitated in shaker | 30 minutes |
| Temperature | +35 deg F. |
| Undigested tar sand | 6.2 grams |
| Grams of water solution | 479.5 |
| Grams Coagulant | 0.10 |
| mls of NaOH solution | 16.3 |
| gms/ml of NaOH Soln | 0.58 |
| Recovered tar "wet" | 5.9 grams |
| Recovered tar "dry" | 2.7 grams |
| Recovered sand | 36.6 grams |
| Tar from "recovered sand" | 8.1 grams |
| Actual tar | 1.0 grams |
| Sand Fines | 6.9 grams |

What is claimed:

1. A process for the recovery of tar from tarsand, said process comprising the steps of:

(a) forming a slurry, wherein said slurry comprises tarsand, an anionic surfactant, at least one high boiling alkane, said alkane boils within the range of from about 225° F. to about 500° F. at 760 mm Hg, and water;

(b) mixing said slurry under conditions effective to remove tar from said tarsand and to form a mixture of (i) substantially tar-free sand and (ii) an emulsion comprising said tar, said high boiling alkane, said anionic surfactant and said water;

(c) separating said substantially tar-free sand from said emulsion; and (d) separately treating said emulsion to separate said tar therefrom.

2. The process of claim 1 wherein the anionic surfactant is selected from the group consisting of $C_8$–$C_{22}$ alkyl benzene sulfonates, $C_8$–$C_{22}$ alkyl sulfates or sulfonates, $C_{10}$–$C_{18}$ alkylether sulfates or sulfonates, $C_8$–$C_{22}$ alkyl or alkylene polyglyceryl sulfonate, $C_8$–$C_{22}$ alkyl ether sulfonate, $C_8$–$C_{22}$ alkylpolyethoxy ether sulfates containing 1 to 12 ethoxy units, $C_8$–$C_{22}$ alpha-olefin sulfonates, $C_8$–$C_{22}$ fatty acid monoglyceride sulfates, $C_8$–$C_{22}$ fatty acid monoglyceride sulfonates, $C_8$–$C_{22}$ alkylphenol polyethoxy ether sulfates containing 10 to 12 ethoxy units, 2-acyloxy-alkane-1-sulfonate, beta-alkyloxy alkoxy alkane sulfonate, and mono-substituted petroleum sulfonate.

3. The process of claim 2 wherein the anionic surfactant is a mono-substituted petroleum sulfonate.

4. The process of claim 1 wherein the high boiling alkane is selected from the group consisting of n-heptane, n-octane, n-nonane, n-decane, n-undecane, n-dodecane, naphtha, i-octane, i-nonane, i-decane and i-dodecane.

5. The process of claim 4 wherein said high boiling alkane is naphtha having a boiling range of from about 250° F. to about 300° F. at 760 mm Hg.

6. The process of claim 1 wherein said slurry is formed by admixing said tarsand, said anionic surfactant, said high boiling alkane and said water in any order.

7. The process of claim 6 wherein said slurry is formed by first admixing said anionic surfactant in said high boiling alkane and then adding said tarsand and then water to that admixture.

8. The process of claim 7 wherein from about 0.1 to about 1.0 weight % of said surfactant, based on the total tarsand weight, is added to about 2.5 to about 25 weight percent high boiling alkane.

9. The process of claim 8 wherein from about 0.1 to about 0.75 weight % of said anionic surfactant is added to about 2.5 to about 18.75 weight % high boiling alkane.

10. The process of claim 9 wherein from about 0.1 to about 0.2 weight % of said anionic surfactant is added to about 5 weight % high boiling alkane.

11. The process of claim 1 wherein the temperature of said slurry prior to conducting said mixing step is from about 32° F. to about 80° F.

12. The process of claim 1 wherein step (d) is carried out by air sparging said emulsion.

13. The process of claim 1 wherein step (d) is carried out by adding to said emulsion sufficient NaOH to precipitate tar therefrom.

14. An extraction process for the recovery of tar from tarsand, said process comprising the steps of:

(a) dissolving an anionic surfactant in a high boiling alkane to provide a alkane/anionic surfactant solution, said high boiling alkane boils within the range of 225° F. to 500° F.;

(b) adding tarsand and water to said alkane/anionic surfactant solution;

(c) agitating the mixture formed in step (b) under conditions effective to remove tar from said tarsand and to form a mixture of (i) substantially tar-free said and (ii) an emulsion of tar, high boiling alkane, anionic surfactant and water;

(e) separating said substantially tar-free sand from said emulsion; and (f) removing said tar from said emulsion.

15. The process of claim 14 wherein said high boiling alkane is naphtha.

* * * * *

UNITED STATES PATENT AND TRADEMARK OFFICE

CERTIFICATE OF CORRECTION

PATENT NO. : 5,746,909

DATED : May 5, 1998

INVENTOR(S) : Jeffrey S. Calta

It is certified that error appears in the above-identified patent and that said Letters Patent is hereby corrected as shown below:

On the Title Page, after Section [76], insert the following:--[73] Assignee: Witco-Corporation, Greenwich, CT

On the Title Page, Attorney, Agent or Firm "Suhgrue, Mion, Zinn, Macpeak & Seas.PLLC" should read --Scullt, Scott, Murphy & Presser--

Column 4, line 28: "a-" should read --α--

Column 6, line 66: "Y2" should read --1/2--

Column 7, line 5: "2 wt% NaOH was used to" --should be deleted therefrom and should be inserted at the beginning of line 6--

Signed and Sealed this

Twenty-seventh Day of June, 2000

*Attest:*

*Attesting Officer*

Q. TODD DICKINSON

*Director of Patents and Trademarks*